US005706595A

United States Patent [19]

Lin

[11] Patent Number: 5,706,595

[45] Date of Patent: Jan. 13, 1998

[54] WAVE-PRODUCING DECORATION

[76] Inventor: Rich Lin, No. 185, Dah Guan Road, Section 2, Panchiao, Taipei Hsien, Taiwan

[21] Appl. No.: 590,433

[22] Filed: Jan. 23, 1996

[51] Int. Cl.[6] ..... G09F 19/00; A63H 23/00

[52] U.S. Cl. ..... 40/406; 40/429; 40/430; 74/48; 188/380; 267/150; 434/126; 446/267

[58] Field of Search ..... 40/406, 429, 430; 74/48; 188/380; 267/150; 434/126; 446/267

[56] References Cited

U.S. PATENT DOCUMENTS

| | | | |
|---|---|---|---|
| 326,052 | 9/1885 | Newbury | 74/48 X |
| 614,684 | 11/1898 | Wright | 74/48 |
| 619,824 | 2/1899 | Fetzer | 74/48 X |
| 1,271,537 | 7/1918 | Bright | 267/150 X |
| 2,793,757 | 5/1957 | McWethy | 188/380 X |
| 3,084,009 | 4/1963 | Heym | 188/380 X |
| 3,155,855 | 11/1964 | Futterer | 267/150 X |
| 3,613,264 | 10/1971 | Vitka et al. | 434/126 |
| 4,176,469 | 12/1979 | Timco | 434/126 |
| 4,238,104 | 12/1980 | Hamilton | 188/380 X |
| 4,403,977 | 9/1983 | Bergles | 267/150 X |
| 5,146,701 | 9/1992 | Lee | 40/406 |
| 5,156,550 | 10/1992 | Alexander | 446/267 X |
| 5,174,760 | 12/1992 | Gray | 40/406 X |

FOREIGN PATENT DOCUMENTS

| | | | |
|---|---|---|---|
| 642911 | 7/1962 | Italy | 267/150 |

OTHER PUBLICATIONS

"The Wave" advertisement; Playthings Aug. 1969, p. 20.

*Primary Examiner*—Kenneth J. Dorner
*Assistant Examiner*—Andrea Chop
*Attorney, Agent, or Firm*—Bacon & Thomas

[57] ABSTRACT

A wave-producing decoration including an elongated liquid container which has an outwardly and downwardly projecting bubble collector integrally formed at a bottom center. The bubble collector communicates with the liquid container and collects any possible bubbles in the container. In addition, the bubble collector has a shape suitable for engaging a seat member partially exposed from a support member of the decoration, such that the liquid container may laterally sway with the pivoting seat member, causing liquid in the container to flow in waves.

6 Claims, 6 Drawing Sheets

WAVE-PRODUCING DECORATION

BACKGROUND OF THE INVENTION

A conventional decoration providing liquid flowing in waves is usually referred to as a "WAVE MACHINE" which has been very popular for many years. The "wave machine" includes a long tube for containing colored oil, water, or dual-liquid therein. The long tube is positioned on a base in adequate height and uses the base as a fulcrum to seesaw within a proper span, causing liquid in the tube to flow in waves in reciprocating movement. Such decoration for producing waves was initially granted a U.S. patent (about at least 17 years ago) and now the term of exclusive use of this patent has expired. For these years, there is not any change made to the structure of such "wave machine". The conventional wave machine always includes a long tube-like liquid container which is supported at a point slightly deviating from its center on a pivot provided on a base and is driven to seesaw by a rotating cam. Since the long tube is not centered on the pivot of the base, it does not swing up and down in a laterally symmetrical manner. That is, liquid in the long tube does not flow in a stable and balanced manner because it's travels from the fulcrum to the right end and to the left end are different. Another drawback existing in the conventional "wave machine" is that the pivot supporting the long tube with liquid tends to break when it is assembled with the long tube or when the product is packed or transported. A further drawback existing in the conventional "wave machine" is that air bubbles are frequently present in the contained liquid because the tube is usually made of plastic material which is subject to thermal expansion and defects formed during manufacturing process. Such bubbles float on the liquid surface to move along with the flowing liquid, obviously spoiling the beautiful scene created by the decoration. Such bubbles cannot be removed once the product is completed and will therefore inevitably adversely affect the function and beauty of the decoration.

SUMMARY OF THE INVENTION

It is a primary object of the present invention to provide a new wave-producing decoration in which an outward and downward projected bubble collector is integrally formed at a bottom center of the liquid-containing tube for collecting bubbles existing in the tube. The bubble collector has a backflow stopper inside it to prevent the air bubbles collected and stored therein from flowing back into the liquid tube. The bubble collector may at the same time serve as a member to engage into a seat member capable of swaying when driven by a driving mechanism, causing the liquid tube to seesaw along with the swaying seat member.

Another object of the present invention is to provide a new wave-producing decoration in which a driving mechanism is used to drive a seat member to sway. The seat member has an upper portion exposed from a top central opening formed on a support member, such that the bubble collector can be easily assembled to or disassembled from the seat member, allowing the liquid tube to use the bubble collector as a central fulcrum to seesaw stably and produce a smooth liquid flow in waves in the tube.

The wave-producing decoration according to the present invention includes a liquid container, a support member supporting the liquid container thereon, and a driving mechanism disposed inside the support member. The liquid container defines a closed space which is optionally partitioned into a front and a rear chambers for containing differently colored dual-liquids. A bubble collector is integrally formed at a bottom center of the liquid container to outwardly project therefrom while communicating with the container. The bubble collector serves not only to remove air bubbles from the liquid container, but also to engage into a seat member. The seat member has a top opening formed on the support member to firmly receive the bubble collector and is driven by the driving mechanism to sway in a stable manner, causing the liquid container to seesaw smoothly and thereby produces liquid flow in waves. The liquid container can be easily assembled to and disassembled from the seat member to enable simpler packing and safe transportation of the whole product.

DETAILED DESCRIPTION OF THE PREFERRED EMBODIMENT

Figure 1:
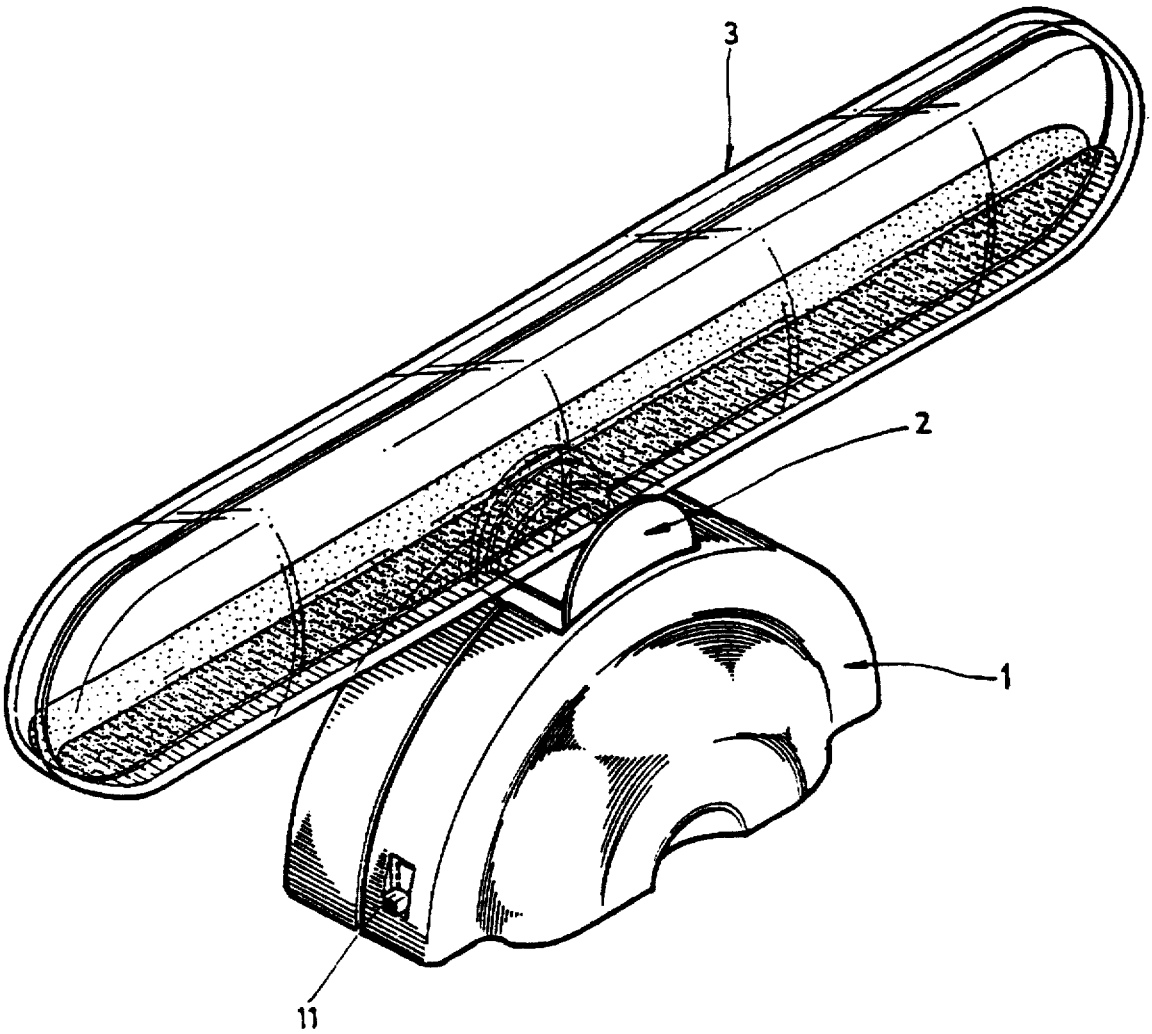
FIG. 1 is a perspective showing the wave-producing decoration according to the present invention.
Figure 2:
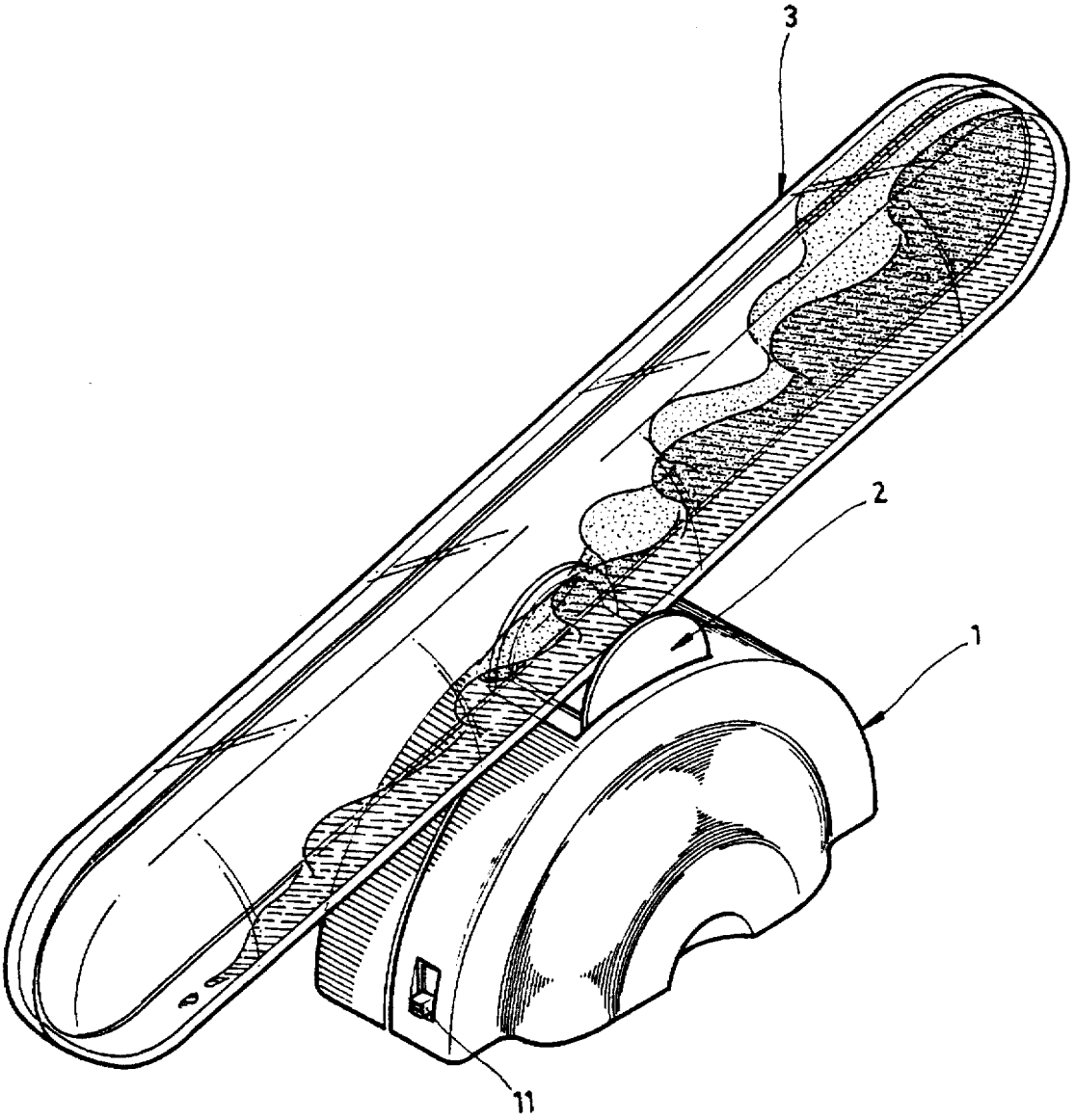
FIG. 2 is a perspective showing the wave-producing decoration of the present invention in operation.

Please refer to FIGS. 1 and 2. The present invention is a wave-producing decoration capable of producing a dynamic view of colorful waves and mainly includes a support member 1, a driving mechanism 2, and a liquid container 3.

The support member 1 is capable of being stably positioned on a generally horizontal surface and accommodates inside it various kinds of necessary electronic components, such as batteries or wires required for connecting to an AC power supply, as well as components forming the driving mechanism 2. A switch 11 is provided on the support member 1 at an adequate position. The support member 1 can be of any configuration so long as it can be maintained stable without contacting the liquid container 3 when the latter is impacted at two ends by the contained liquid flowing to either end thereof while the container 3 swings up and down like a seesaw.

The liquid container 3 is in a form of long hollow tube defining a closed space which can be optionally partitioned into front and rear chambers for containing liquids of different colors. The contained liquid is a dual-liquid consisting of colored water and a second fluid. The colored water permits the dual-liquid to flow in waves when the liquid container 3 swings up and down. Differently colored water in two chambers may produce a third color or shade when they are visually overlapped in the liquid container 3, permitting the decoration of the present invention to be more changeful and attractive than a conventional one-color wave machine. The liquid container 3 is pivotally supported at its bottom center on the support member 1 such that two ends of it are allowed to swing up and down like a seesaw. When the liquid container 3 is driven by the driving mechanism 2 to seesaw slowly within a predefined range, the colored liquid therein keeps flowing in waves from a higher position at one end of the container 3 down to a lower position at the other end of the container 3 in a reciprocating movement.

Figure 3:
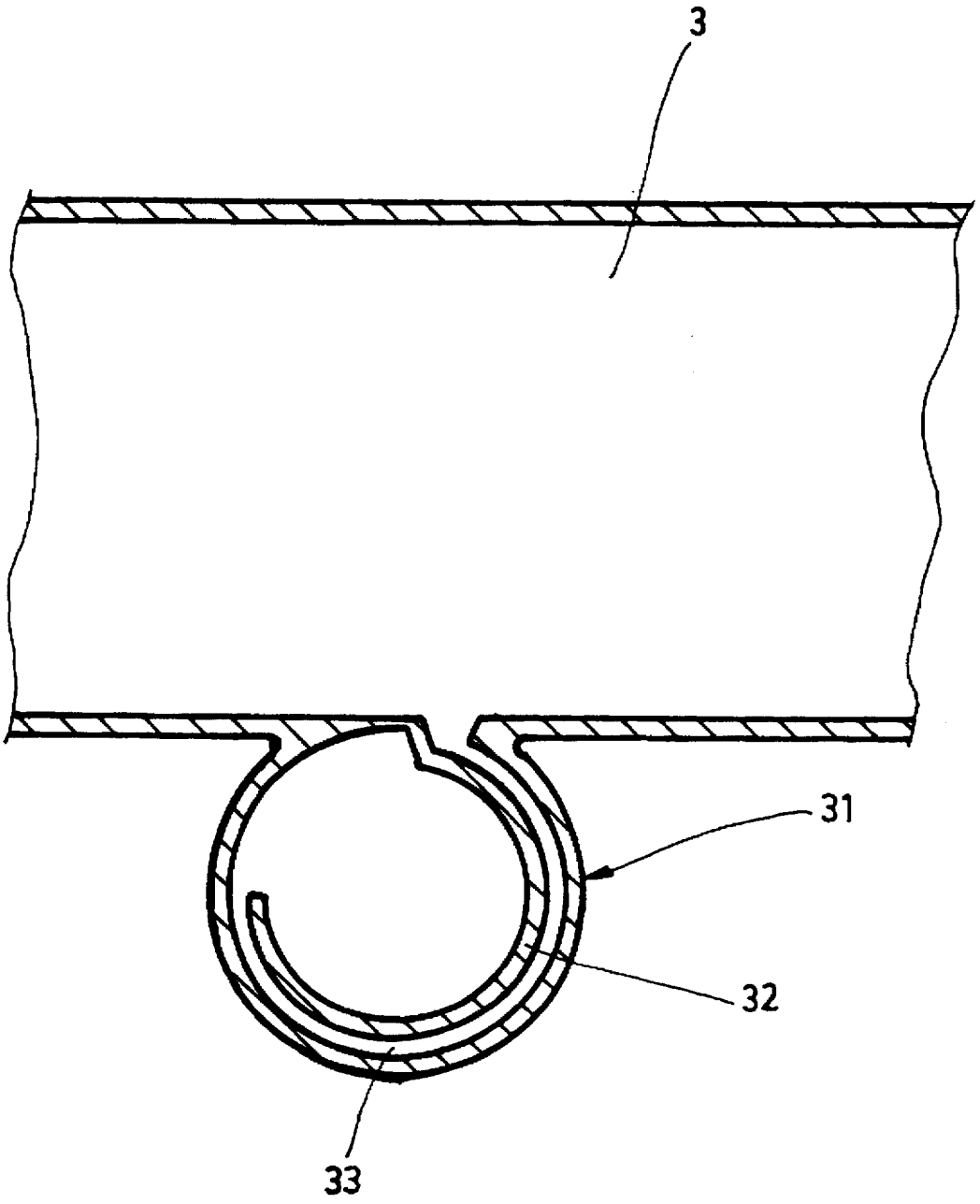
FIG. 3 is an enlarged, fragmentary, sectional view showing the structure of the liquid container of the present invention.

As shown in FIG. 3, the liquid container 3 has two ends in considerable thickness, and an outwardly and downwardly projecting cylindrical air bubble collector 31 integrally provided at a bottom center of the container 3. The bubble collector 31 is preferably cylindrically shaped and communicates with the container 3. A backflow stopper 32 is provided to extend from an inlet of the bubble collector 31 along an inner wall thereof until it passes over a point opposite to the inlet of the bubble collector 31 for at least some distance, forming a backflow passage 33 between the backflow stopper 32 and the inner wall of the bubble collector 31. When there is any bubble existing in the liquid container 3, the container 3 can be turned upside down so that bubbles in the container 3 are guided into the bubble collector 31 via the backflow passage 33. Then, the container 3 is turned again to its original position. At this point, the bubbles are collected in the bubble collector 31 at a top portion thereof and are prevented by the backflow stopper 32 from escaping therefrom to enter the liquid container 3 again. Due to an adequate length of the backflow stopper 32, bubbles collected will not escape from the bubble collector 31 even when the bubble collector 31 pivotally rotates along with the swinging liquid container 3 to a certain extent. When the liquid container 3 is of a two-chamber structure, the bubble collector 31 is formed with two-chambers, too, corresponding to the liquid container 3, so as to collect bubbles in respective chambers of the container 3.

The bubble collector 31 is preferably formed to have a cylindrical shape so that it is suitable for smoothly collecting the bubbles and for easily and stably engaging a seat member 21 of the driving mechanism 2 which is mounted in the support member 1 with only one component, that is, the seat member 21, exposed to the outside from a top opening 12 of the support member 1.

Figure 4:
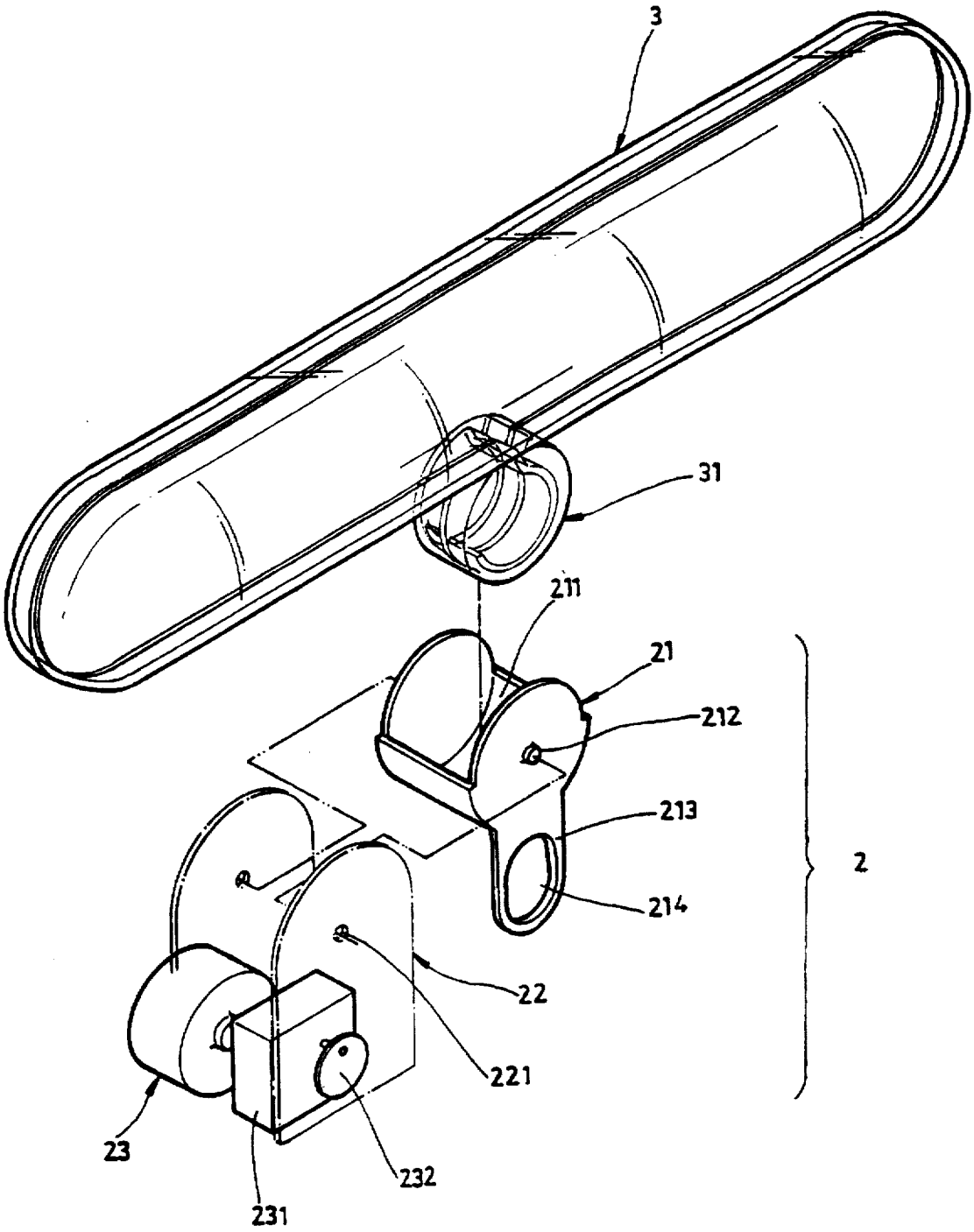
FIG. 4 is an exploded perspective showing the main parts of the present invention and the manner in which these parts are assembled.
Figure 5:
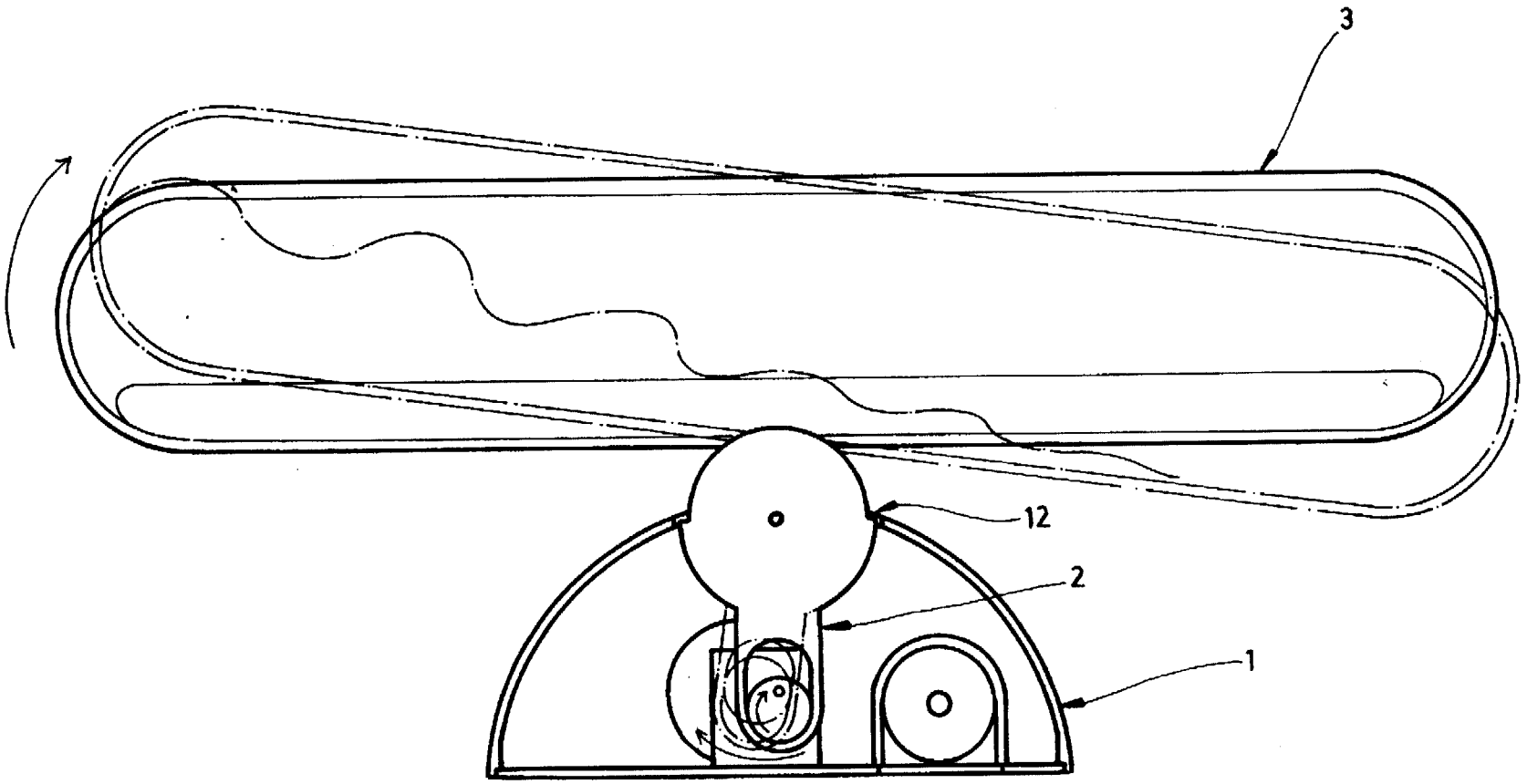
FIG. 5 is a front sectional view showing the operation of the present invention.
Figure 6:
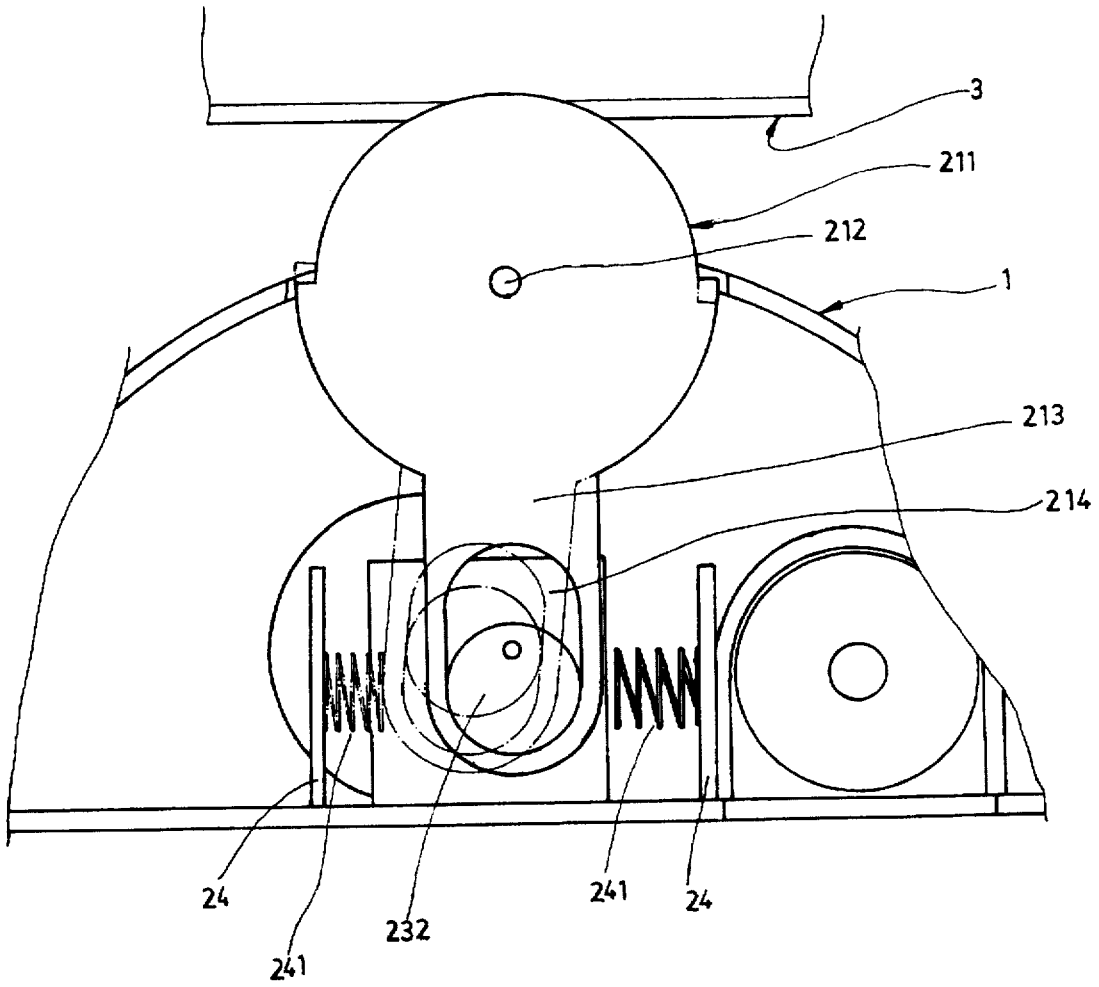
FIG. 6 is an enlarged, fragmentary, sectional view showing particularly the movement of the swaying seat of the present invention.

As shown in FIGS. 4 and 5, the seat member 21 includes a seat portion 211 having two side walls, a pair of supporting shafts 212 fixed to two side walls of the seat portion 211, and an arm portion 213 downward extending from one side wall of the seat portion 211 and having a vertically extended oblong opening 214 formed thereon. The entire seat member 21 is pivotally mounted on a frame member 22 with the pair of supporting shafts 212 pivotally and rotatably extending into two shaft holes 221 formed on two side walls of the frame member 22, such that the oblong opening 214 of the arm portion 213 of the seat member 21 locates around an eccentric 232 of the driving mechanism 2. The eccentric 232 is rotated by a motor 23 via a gear box 231 to which the eccentric 232 is connected. The oblong opening 214 has a height larger than a diameter of the eccentric 232 and a width equal to the diameter of the eccentric 232. Thereby, when the eccentric 232 is rotating, it causes the arm portion 213 to pivotally and laterally sway about the supporting shafts 212 within a defined span. The seat portion 211, therefore, pivotally sways up and down a similar manner. Since the bubble collector 31 is directly stably engaged into the seat portion 211 of the seat member 21, the liquid container 3, which is integrally formed with the bubble collector 31, shall seesaw up and down along with the swaying seat member 21, causing the dual-liquid in the container 3 to flow in waves.

Whenever the container 3 is seesawed with one of its two ends reaching the lowest point it is permitted to have, the liquid in the container 3 shall flow toward the lowering end at higher speed. And, when the container 3 is swayed to lift the lowered end again, the liquid just flowed to the lowest point shall gain a higher momentum when it flows from the lifted end toward the lowered end. This will cause the container 3 to sway in an unstable manner. A solution provided by the present invention for this problem is to erect at two sides of the eccentric 232 two plates 24 each having a cushion spring 241 sidewardly mounted thereon to project inward toward the eccentric 232, such that when the arm portion 213 moves to a rightmost or leftmost position, that is, when the container 3 has one end thereof at the lowest position, one of the springs 241 is compressed by the arm portion 231 to moderate or store the force the downward liquid flow acting on the swaying container 3.

In addition, to prevent either end of the seesawing liquid container 3 from contacting the seat member 21, it is necessary to consider the span or angle within which the bubble collector 31 is allowed to pivotally rotate. The bubble collector 31 to fitly engages the seat portion 211 without adversely affecting the smooth swaying of the container 3 and permits easy dismounting and/or assembling of the bubble collector 31 from or to the seat member 21 for safe and convenient packing or transportation purpose. The tightness of contact of the assembled bubble collector 31 with the seat member 21 should be carefully considered.

What is claimed is:

1. A wave-producing decoration, comprising an elongated, hollow liquid container having a longitudinal axis defining a closed space, containing at least one liquid; a generally cylindrical bubble collector having a longitudinal axis which is perpendicular to said longitudinal axis of said liquid container and having a curved outer wall extending outwardly from a bottom of the liquid container and bounding a bubble collecting chamber with an inlet communicating with the closed space in the liquid container, the bubble collector having an internal, curved backflow stopper wall extending from the inlet past a point on the curved outer wall opposite the inlet so as to form a curved backflow passage between the backflow stopper wall and the curved outer wall;

a support member;

a driving mechanism comprising a motor driving a rotating eccentric member, the driving mechanism located in the support member; and, a seat member pivotally located on the support member and having a seat portion receiving the bubble collector therein, the seat member connected to the eccentric member such that rotation of the eccentric member causes oscillation of the seat member and the liquid container.

2. The wave-producing decoration as claimed in claim 1, wherein said seat member has an arm portion with an elongated opening therein extending therefrom located such that the eccentric member engages the elongated opening.

3. The wave-producing decoration as claimed in claim 2, wherein said seat portion has two supporting shafts extending from opposite side walls engaging two shaft holes formed on two side walls of a frame member located within said support member.

4. The wave-producing decoration as claimed in claim 1, wherein said bubble collector of said liquid container is removably mounted on said seat portion.

5. The wave-producing decoration as claimed in claim 1 wherein the liquid container further comprises a partition dividing the closed space into front and rear chambers.

6. The wave-producing decoration as claimed in claim 1 wherein the driving mechanism further comprises a gearbox driven by the motor and driving the eccentric member.

* * * * *